United States Patent [19]

Antipov et al.

[11] 4,232,750

[45] Nov. 11, 1980

[54] IMPACT WRENCH WITH A ROTARY TOOL DRIVE

[76] Inventors: Georgy A. Antipov, ulitsa Krasny Mayak, 3, kv. 146; Mikhail L. Gelfand, Yaroslavskoe shosse, 129, kv. 44; Boris G. Goldshtein, ulitsa Molodogvardeiskaya, 24, korpus 1, kv. 26, all of Moscow; Mikhail I. Rutgaizer, ulitsa Kuibysheva, 4, kv. 5; Nikolai K. Suut, ulitsa Lenina, 38, kv. 90, both of Vyborg Leningradskoi oblasti; Yakov I. Tsipenjuk, ulitsa Kirova, 5, kv. 30, Solntsevo Moskovskoi oblasti; Jury P. Shishulin, Jubileiny prospekt, 18, kv. 30, Khimki Moskovskoi oblasti; Apas G. Galimov, ulitsa Kuibysheva, 15, kv. 13, Sverdlovsk; Oleg Y. Sutyagin, ulitsa Dekabristov, 5, kv. 51, Sverdlovsk; Oleg A. Yankovsky, ulitsa Soni Morozovoi, 175a, kv. 95, Sverdlovsk, all of U.S.S.R.

[21] Appl. No.: 954,756

[22] Filed: Oct. 26, 1978

[51] Int. Cl.[2] ..... B25B 21/02

[52] U.S. Cl. ..... 173/93.6

[58] Field of Search ..... 173/93.6, 93, 97, 109, 173/111, 117, 94, 104, 12, 93.5, 15; 81/52.3, 52.35

[56] References Cited

U.S. PATENT DOCUMENTS

| | | | |
|---|---|---|---|
| 2,520,920 | 9/1950 | Fosnot | 173/93.5 |
| 2,786,376 | 3/1957 | Roggenburk | 173/93.5 |
| 3,760,886 | 9/1973 | Mori et al. | 173/93.6 |
| 3,804,180 | 4/1974 | Gelfand et al. | 173/93 X |
| 3,952,814 | 4/1976 | Gelfand et al. | 173/93 |

*Primary Examiner*—Werner H. Schroeder
*Assistant Examiner*—Andrew M. Falik
*Attorney, Agent, or Firm*—Holman & Stern

[57] ABSTRACT

An impact wrench comprises a casing accommodating an axially immovable anvil having impact jaws, an axial bore and a counterbore in the axial bore, a composite hammer including a driving part coupled to a motor for rotation together therewith, an outer driven part having impact jaws engageable with the impact jaws of the hammer, and an inner driven part received in the counterbore of the anvil. The outer and inner driven parts of the hammer are connected to each other and to the driving part of the hammer for combined rotation therewith and being axially movable relative to the driving part of the hammer and to the anvil. The impact wrench also comprises a device for a preliminary interaction of the hammer and anvil before engagement of their impact jaws, including spring-loaded locking members. The spring-loaded locking members are mounted in the inner driven part of the hammer in an axial space between the impact jaws of the hammer and anvil. This construction of the impact wrench results in reduced axial dimension of the tool and improved reliability.

4 Claims, 12 Drawing Figures

IMPACT WRENCH WITH A ROTARY TOOL DRIVE

FIELD OF THE INVENTION

The invention relates to impact wrenches, and more specifically to impact wrenches used in various industries for torque tightening of vital threaded joints.

STATE OF THE ART

There are known so-called "rare-blow" impact wrenches in which a hammer is brought into engagement with an anvil after being accelerated at any desired number of revolutions of a drive shaft, the blow rate being as low as 2–3 blows per second. Said impact wrenches have a synchronizing device ensuring the complete engagement of impact jaws of the hammer and anvil. The impact wrenches of this type are advantageous in the lack of vibrations, high specific output (blow energy-to-mass of the tool ratio), coupled with accurate tightening of threaded joints. Moreover, such impact wrenches feature generally high reliability.

Thus, known in the art is an impact wrench (cf. U.S. Pat. No. 3,804,180, Cl. 173-15) comprising a hammer having impact jaws, an axially movable anvil having impact jaws, and a locking device providing an axial space between the impact jaws of the hammer and anvil until the hammer gains a pre-set rotary speed. The provision of such a device in the impact wrench prevents a blow from being transmitted with an incomplete engagement of the impact jaws of the hammer and anvil thus considerably lowering wear thereof, ensures stable impact energy of every blow, and eliminates vibrations of the casing. This impact wrench cannot, however, operate in an automatic cycle for imparting a series of blows, which hampers productive operation.

Also known in the art is an impact wrench (cf. U.S. Pat. No. 3,952,814) in which the casing accommodates an axially immovable anvil having impact jaws, a composite hammer which is formed by a driving part of a drive coupled to an output shaft, an outer driven part having impact jaws, and an inner driven part, and also a device for a preliminary interaction of the hammer and anvil before engagement of their impact jaws. This device comprises spring-loaded locking members oriented with respect to the impact jaws of the hammer and cam surfaces of the anvil.

This construction of the impact wrench ensures the complete engagement of the impact jaws of the hammer and anvil during operation in an automatic hammering cycle.

The spring-loaded locking members and the inner driven part of the hammer of the above-described impact wrench are accommodated in the hammer thus making the hammer relatively long.

Moreover, the cam surfaces of the anvil are provided on a tubular member mounted to the anvil and projecting therefrom towards the hammer thereby also increasing the axial dimension of the impact wrench.

In addition, the impact wrench of the prior art has ball pushers co-operating with the locking members to make the structure somewhat complicated.

SUMMARY OF THE INVENTION

A primary object of the invention is to provide an impact wrench of a simple construction.

Another object of the invention is to provide an impact wrench which is reliable in operation and has a reduced axial dimension compared with known wrenches.

With these and other objects in view, an impact wrench comprises a casing accommodating an axially immovable anvil having impact jaws and an axial bore. A spindle is connected to the anvil for rotation together therewith. A composite hammer includes a driving part coupled to a motor for rotation together therewith, an outer driven part having impact jaws engageable with the impact jaws of the anvil, and an inner driven part. The outer and inner driven parts of the hammer are connected to each other and to the driving part of the hammer for a combined rotation. In addition, the driven parts are axially movable relative to the driving part of the hammer and to the anvil under the action of flyweights located between the driving part of the hammer and the outer driven part of the hammer. The wrench further includes a working spring, a return spring mounted between the driven parts of the hammer, a device for a preliminary interaction of the hammer and anvil before engagement of their impact jaws, including spring-loaded locking members oriented with respect to the impact jaws of the hammer and cam surfaces of the anvil. According to the invention, the spring-loaded locking members are mounted in the inner driven part of the hammer in an axial space between the impact jaws of the hammer and anvil, and a counterbore is provided in the axial bore of the anvil to receive the inner driven part of the hammer and the working spring which is mounted between the inner driven part of the hammer and the anvil.

Therefore, owing to the accommodation of the inner driven part of the hammer in the counterbore of the anvil and of the spring-loaded locking members in the inner driven part of the hammer the construction of the impact wrench is considerably simplified, and reliability of the impact clutch is improved. Moreover, the axial dimension of the tool is reduced thus lowering the mass and enlarging the operational capabilities of the impact wrench.

In accordance with one embodiment of the invention, the inner driven part of the hammer comprises a sleeve which is axially movable on an axle disposed in the casing. The inner driven part of the hammer is preferably provided with axially extending projections facing the motor, and the outer driven part of the hammer is provided with recesses to receive the axially extending projections of the inner driven part of the hammer.

In accordance with another embodiment of the invention, the inner driven part of the hammer comprises an axially movable intermediate shaft one end of which is journalled in the axial bore of the anvil.

In accordance with the invention, the spring-loaded locking members are provided with bevels facing the anvil, which are engageable with the cam surfaces of the anvil which are formed on the impact jaws thereof.

BRIEF DESCRIPTION OF THE ACCOMPANYING DRAWINGS

The impact wrenches according to the invention will now be described in detail with reference to the accompanying drawings, in which.

DETAILED DESCRIPTION OF THE INVENTION

Figure 1:
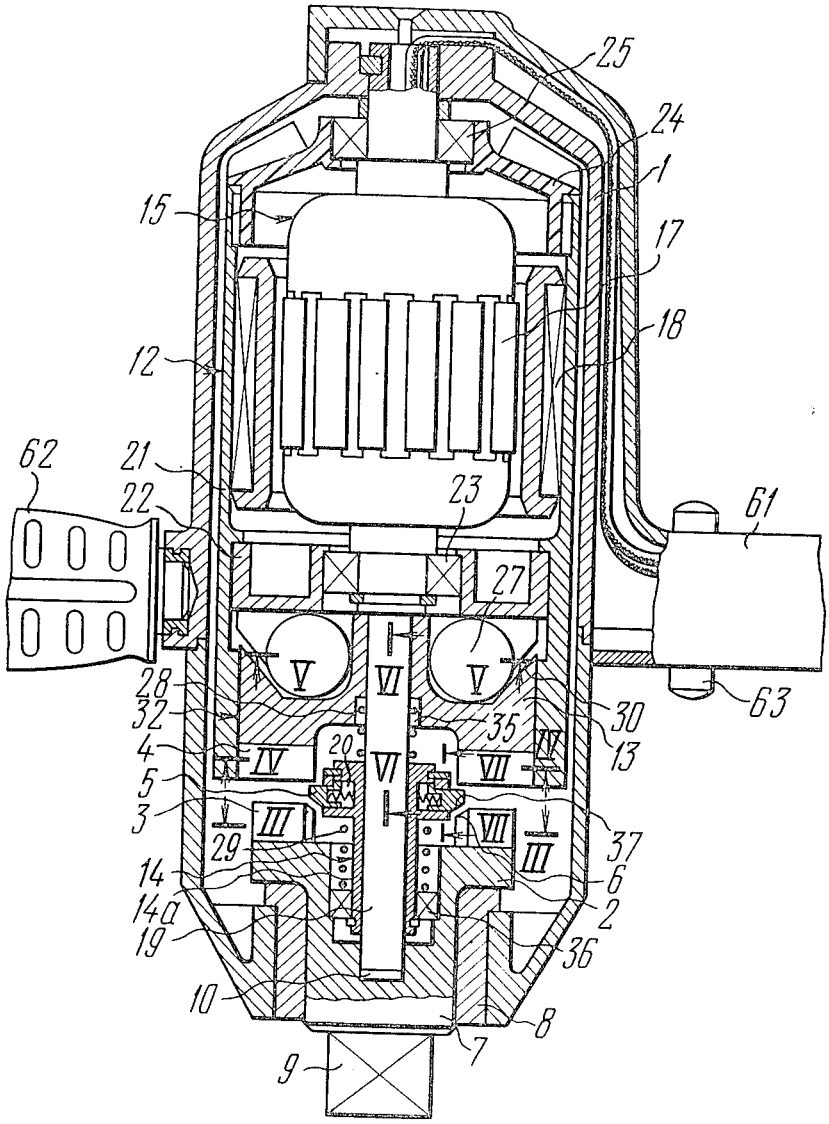
FIG. 1 shows a longitudinal section of an impact wrench according to the invention, with an electric motor.
Figure 2:
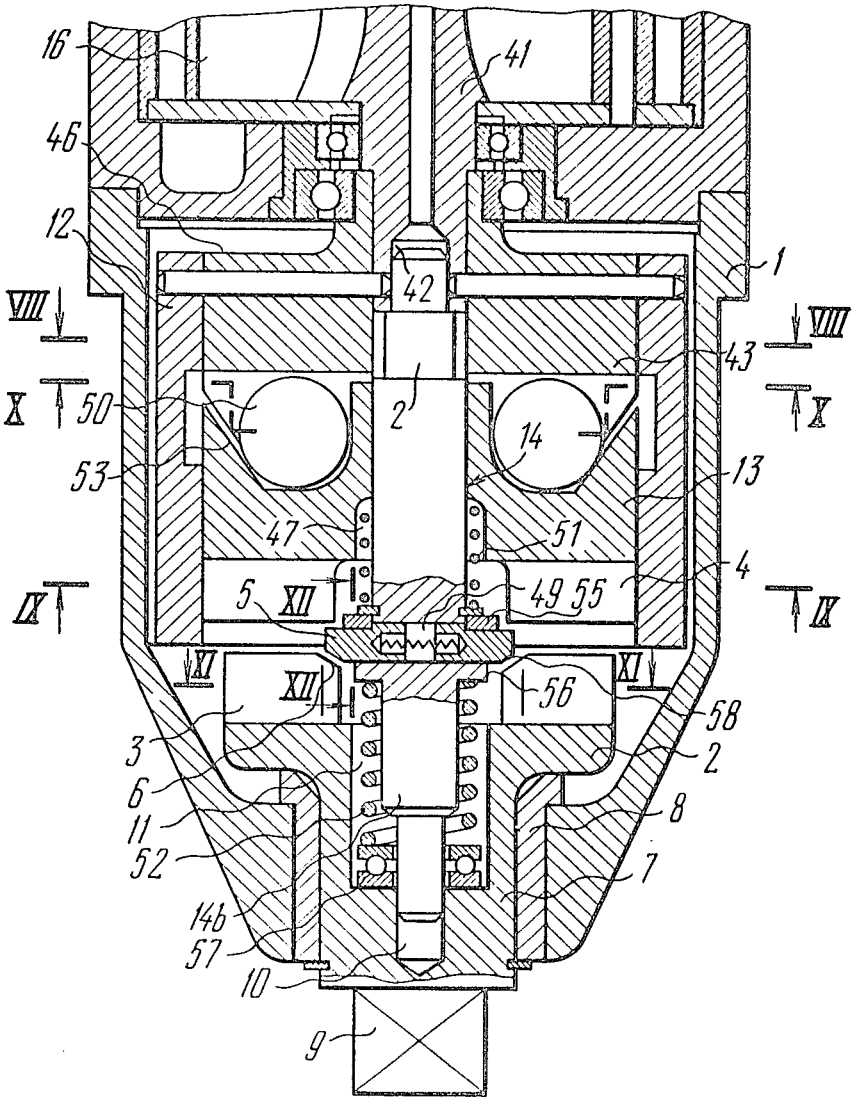
FIG. 2 is a fragmentary view in longitudinal section of an impact wrench according to the invention, with a pneumatic motor.
Figure 3:
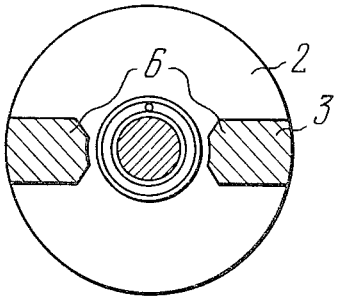
FIG. 3 is a sectional view taken along line III—III of FIG. 1.

Each of the impact wrenches shown in FIGS. 1 and 2 comprises a casing 1 accommodating an anvil 2 having impact jaws 3, a composite hammer having impact jaws 4 engageable with the impact jaws 3 of the anvil, a drive for rotating the hammer and a device for a preliminary interaction of the hammer and anvil before engagement of their impact jaws 3 and 4, respectively, including spring-loaded locking members 5 and cam surfaces in the form of bevels 6 provided on the impact jaws 3 of the anvil 2 (FIG. 3).

The anvil 2 (FIGS. 1 and 2) is journalled in the casing 1 in an axially immovable manner and is connected to a spindle 7 for rotation together therewith or made integral therewith as shown in FIGS. 1 and 2. The spindle 7 is journalled in a bushing 8, and an end 9 of the spindle extending outside the casing is of a square cross-section for attachment of a socket wrench.

The anvil 2 has an axial bore 10 and a counterbore 11. The composite hammer is formed by a driving part 12, an outer driven part 13 having the impact jaws 4 and mounted inside the driving part 12 of the hammer, and an inner driven part 14 received in the counterbore 11 of the anvil 2, the spring-loaded locking members 5 being also mounted in the inner driven part 14 of the hammer, as shown in FIGS. 1 and 2, and oriented with respect to the impact jaws 4 of the hammer.

The drive for rotating the hammer may comprise either an electric motor 15, as shown in FIG. 1, or a pneumatic motor 16, as shown in FIG. 2.

In an embodiment shown in FIG. 2 use can also be made of a conventional electric motor (e.g., a universal commutator motor or a squirrel-cage induction motor).

The electric motor 15 of the impact wrench shown in FIG. 1 includes a stationary rotor 17 and a rotary stator 18. The rotor 17 is mounted on a stationary axle 19 journalled in a bore of the casing 1 and in the axial bore 10 of the anvil 2. The inner driven part 14 of the hammer comprises in this embodiment a sleeve 14*a* having radial bores 20 located at the level of an axial space between the impact jaws 3 and 4 of the anvil and hammer. The spring-loaded locking members 5 are mounted in the bores 20.

The driving part 12 of the hammer is rigidly secured to the stator 18 of the electric motor 15 for rotation together therewith and comprises a cylindrical guide cage 21 embracing the stator 18 of the electric motor, a support 22 mounted on a bearing 23 of the axle 19, and a cover 24 mounted on a bearing 25 of the axle 19, the support 22 and the cover 24 being rigidly secured to the guide cage 21.

Figure 4:
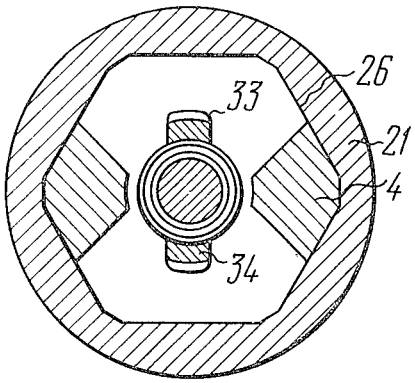
FIG. 4 is a sectional view taken along line IV—IV of FIG. 1.

The cylindrical guide cage 21 of the driving part 12 of the hammer has an inner, e.g. hexagonal, surface 26 (FIG. 4).

The inner 14 (FIG. 1) and outer 13 driven parts of the hammer are mounted on the fixed axle 19 and are connected to each other and to the driving part 12 of the hammer for combined rotation. The inner 14 and the outer 13 driven parts of the hammer are axially movable relative to the driving part 12 of the hammer and to the anvil 2 under the action of flyweights 27 comprising balls, return spring 28 and working spring 29.

Figure 5:
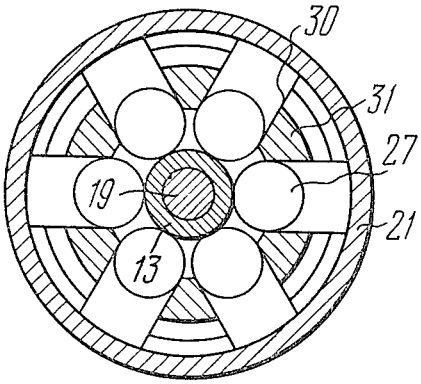
FIG. 5 is a sectional view taken along line V—V of FIG. 1.

The flyweights 27 are disposed between the outer driven part 13 of the hammer and the support 22 of the driving part 12 of the hammer, the outer driven part 13 of the hammer having bevels 30 facing the electric motor 15, and the support 22 having projections 31 (FIG. 5) facing the anvil 2. The flyweights 27 are located between the bevels 30 and the projections 31.

Figure 6:
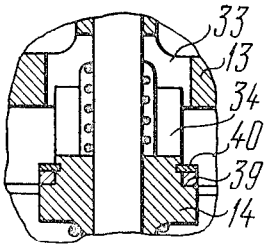
FIG. 6 is a sectional view taken along line VI—VI of FIG. 1.

The outer driven part 13 (FIG. 1) of the hammer has an outer hexagonal surface 32 mating with the inner hexagonal surface 26 (FIG. 4) of the cylindrical guide cage 21 so that the outer driven part 13 of the hammer may rotate together with the driving part 12 of the hammer. Moreover, the outer driven part 13 (FIG. 6) of the hammer has two recesses 33 facing the inner driven part 14 of the hammer, and the inner driven part 14 of the hammer has two axially extending projections 34 facing the electric motor, which are received in the recesses 33. With such interconnection of the driven parts 13 and 14 and driving part 12 (FIG. 1) of the hammer, the driven parts 13 and 14 of the hammer may rotate and move in the axial direction.

The return spring 28 is mounted between the outer 13 and inner 14 driven parts of the hammer and has one end which abuts against the end face of the inner driven part 14 and the other end which is received in a counterbore 35 of the inner driven part 13.

The working spring 29 is received in the counterbore 11 of the anvil 2 between the inner driven part 14 of the hammer and the anvil 2 and has one end which abuts against a bearing 36 which is provided for journalling the inner driven part 14 of the hammer in the counterbore 11 of the anvil 2, and the other end which abuts against a shoulder of the inner driven part 14 of the hammer as shown in FIG. 1.

The spring-loaded locking members 5 have bevels 37 facing the anvil, which are engageable with the bevels 6 of the impact jaws 3 of the anvil 2.

Figure 7:
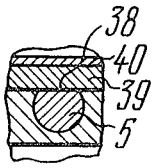
FIG. 7 is a sectional view taken along line VII—VII of FIG. 1.

The spring-loaded locking members 5 (FIG. 7) are of a round cross-section and each has a flat 38 for the orientation of the locking members in the bores 20. The locking members 5 are retained from falling out of the bores 20 by means of a ring 39 and a retaining ring 40.

The impact wrench shown in FIG. 2, has a pneumatic motor 16 of any appropriate known design, which has an output shaft 41 to which is rigidly secured the driving part 12 of the hammer. The end of the shaft 41 is of a triangular cross-section and has an axial bore 42. The shaft 41 supports a disc 43 having an internal trihedral surface 44 (FIG. 8) and an outer hexagonal surface 45.

The driving part 12 of the hammer is mounted externally on the disc 43 and also has an inner hexagonal surface, the driving part 12 being connected to the disc 43 and to the shaft 41 by means of pins 46 (FIG. 2) to prevent the axial displacement of the driving part 12 and disc 43.

Figure 9:
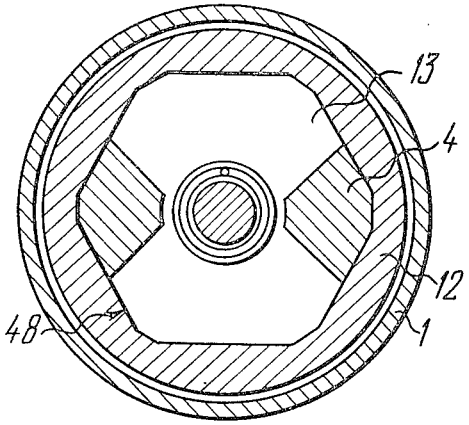
FIG. 9 is a sectional view taken along line IX—IX of FIG. 2.

The outer driven part 13 of the hammer has an axial bore, a counterbore 47 and an outer hexagonal surface 48 (FIG. 9) which mates with the driving part 12 of the hammer for a combined rotation therewith and for an axial movement relative to the driving part 12.

Figure 8:
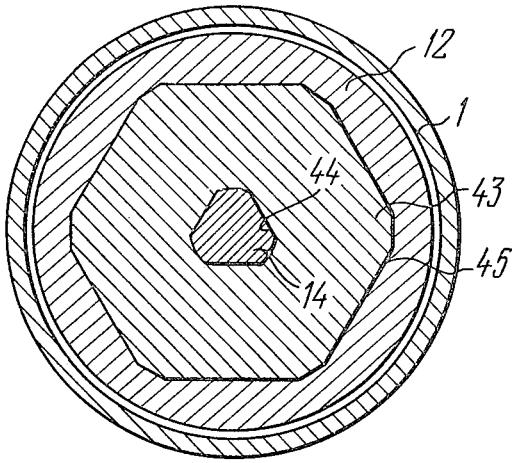
FIG. 8 is a sectional view taken along line VIII—VIII of FIG. 2.

The inner driven part 14 (FIG. 2) of the hammer comprises an intermediate shaft **14*b* extending through the axial hole of the outer driven part 13 of the hammer and journalled in the axial bore 10 of the anvil 2 and in the bore 42 of the drive shaft 41. The inner driven part 14 mates with the disc 43 along the trihedral surface 44 as shown in FIG. 8 so that the driven part 14 may rotate together with the disc 43 and the driving part 12 of the hammer and move axially relative to the outer driven part 13, anvil 2 and driving part 12** of the hammer.

The inner driven part 14 (FIG. 2) of the hammer, that is the intermediate shaft **14*b*, has a diametrical bore 49 at the level of an axial space between the impact jaws 4 and 3 of the hammer and anvil 2. The bore 49 accommodates the spring-loaded locking members 5**.

Figure 10:
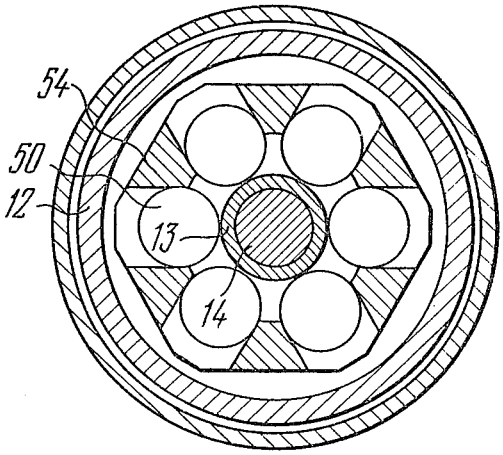
FIG. 10 is a sectional view taken along line X—X of FIG. 2.

The axial movement of the driven parts 13 and 14 of the hammer is caused by flyweights 50 comprising balls, return spring 51 and working spring 52. The flyweights 50 are located between the disc 43 and the outer driven part 13 of the hammer in recesses defined by beveled surfaces 53 provided on the outer driven part 13, and projections 54 (FIG. 10) of the disc 43. The return spring 51 (FIG. 2) is disposed between the driven parts 13 and 14 of the hammer and has one end received in the counterbore 47 of the outer driven part 13 of the hammer and the other end which abuts against a shoulder of the inner driven part 14 (i.e., the intermediate shaft **14*b*) formed by a ring 55. The working spring 52 is received in the counterbore 11 of the anvil 2 between the inner driven part 14 of the hammer and the anvil 2 and has one end which abuts against a shoulder 56 of the intermediate shaft 14*b*, and the other end which abuts against a bearing 57 disposed in the counterbore 11**.

Figure 11:
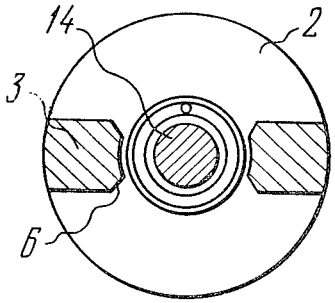
FIG. 11 is a sectional view taken along line XI—XI of FIG. 2.

The spring-loaded locking members are provided with bevels 58 facing the anvil 2, which are engageable with the bevels 6 of the impact jaws 3 (FIG. 11) of the anvil 2.

Figure 12:
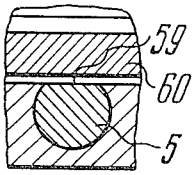
FIG. 12 is a sectional view taken along line XII—XII of FIG. 2.

The spring-loaded locking members 5 have flats 59 (FIG. 12) for the orientation in the bore 49 of the intermediate shaft **14*b* and are retained from falling out by means of expansion ring 60**.

The impact wrenches have a main handle 61 (FIG. 1), a lateral handle 62 and a pushbutton 63 for starting the motor.

DESCRIPTION OF OPERATION

The impact wrenches shown in FIGS. 1 and 2 operate in the following manner.

A socket wrench (not shown) is put on the spindle 7 (FIGS. 1 and 2) and is applied to a threaded fastener. After the pneumatic motor 16 (FIG. 2) or electric motor 15 (FIG. 1) is energized, the hammer is accelerated, the rotation being transmitted to the driving part 12 of the hammer and to its driven parts 13 and 14. As the hammer speed increases, the flyweights 27 or 50 (FIG. 2) move under the action of centrifugal force from the center towards the periphery to act on the beveled surfaces of the outer driven part 13 of the hammer and to cause its axial movement towards the anvil 2 to compress the spring 51 (FIG. 2) or 28 (FIG. 1).

Upon the axial movement of the outer driven part 13 of the hammer the driven part 14, that is the sleeve **14*a* (FIG. 1) or the intermediate shaft 14*b* (FIG. 2), also moves to compress the spring 29 (FIG. 1) or 52 (FIG. 2). The spring-loaded locking members 5 will not permit the impact jaws 4 of the hammer to come into engagement with the impact jaws 3 of the anvil 2 until the bevels 37 (FIG. 1) or 58 (FIG. 2) of the locking members engage the bevels 6 of the impact jaws 3 of the anvil 2. Upon this engagement, the spring-loaded locking members 5 are forced into the bore 49 (FIG. 2) or 20 (FIG. 1) of the inner driven part 14 to release the outer driven part 13 of the hammer for further movement towards the anvil 2 at the moment when the impact jaws 4 of the hammer are located opposite to the impact jaws 3 of the anvil 2. The spring 29 (FIG. 1) or 52 (FIG. 2) is thus completely compressed, and a blow is imparted to transmit the kinetic energy accumulated by the hammer to the threaded joint being tightened through the spindle 7**.

At the moment of blow, the rotary speed of the hammer drops to zero, and the flyweights 50 (FIG. 2) or 27 (FIG. 1) return back from the periphery to the center. The spring 28 (FIG. 1) or 51 (FIG. 2) retracts the outer driven part 13 of the hammer away from the anvil 2 and withdraws the impact jaws 4 of the hammer from engagement with the impact jaws 3 of the anvil 2. The spring-loaded locking members 5 are also returned to the initial position under the impact jaws 4 of the hammer, and the inner driven part 14 of the hammer is returned by the spring 52 (FIG. 2) or 29 (FIG. 1). Then the above-described cycle is repeated (with the motor running) until a desired amount of energy is transmitted to the threaded joint to tighten it.

What is claimed is:

1. An impact wrench comprising: a casing; a motor accommodated in said casing; a spindle journalled in said casing; an anvil having impact jaws and an axial bore, said anvil being coupled to said spindle for rotation therewith and being fixed axially with respect to said casing; a counterbore in said axial bore of said anvil; a composite hammer accommodated in said casing and including a driving part coupled to said motor for rotation therewith, an outer driven part connected to said driving part for combined rotation and having impact jaws engageable with the impact jaws of said anvil, and an inner driven part connected to the outer driven part for combined rotation and received in said counterbore of the anvil; said driven parts of the hammer being axially movable relative to said driving part of the hammer; flyweights located between said driving part of the hammer and said outer driven part of the hammer, axial movement of the driven parts of the hammer for bringing the impact jaws of the hammer and anvil into engagement being caused by said flyweights on rotation of said driving part of the hammer; a return spring mounted between said driven parts of the hammer; a device for providing preliminary interaction of the hammer and anvil before engagement of their respective impact jaws, including spring-loaded locking means and cam surfaces of said anvil, said spring-loaded locking members being mounted in the inner driven part of the hammer in an axial space between the impact jaws of said hammer and anvil; means defining cam surface means on the anvil and a working spring received in said counterbore of the anvil between said inner driven part of the hammer and said anvil, said device preventing engagement of the respective impact jaws until said locking means is moved from between the impact jaws by engagement with said cam surface means.

2. An impact wrench comprising: a casing; a motor accommodated in said casing and including a rotor fixedly secured in the casing and having an axle, and a stator rotatable relative to said rotor; a spindle journalled in the casing; an anvil having impact jaws and an axial bore, said anvil being coupled to the spindle for rotation therewith and being fixed axially with respect to the casing, said axle of the rotor being journalled in said axial bore of the anvil; a counterbore in said axial bore of said anvil; a composite hammer accommodated in said casing and including a driving part coupled to said stator of the motor for rotation therewith, an outer driven part connected to said driving part for combined rotation and having impact jaws engageable with the impact jaws of said anvil, and an inner driven part connected to said outer driven part of the hammer for combined rotation, said inner part being received in said counterbore of the anvil and comprising a sleeve mounted on said axle of the rotor, said driven parts of the hammer being axially movable relative to said driving part of the hammer; flyweights located between said driving part of the hammer and said outer driven part of the hammer, axial movement of said driven parts of the hammer for bringing the impact jaws of the hammer into engagement with the impact jaws of the anvil being caused by said flyweights; a return spring mounted between said driven parts of the hammer; a device for providing preliminary interaction of said hammer and anvil before engagement of their impact jaws, including spring-loaded locking means mounted in said inner driven part of the hammer and located in an axial space between the impact jaws of said hammer and anvil; cam surface means formed on the anvil and a working spring received in said counterbore of said anvil between said inner driven part of the hammer and said anvil, said locking means engaging said cam surface means on movement of said inner driven parts of the hammer to move said locking means from between the respective impact jaws and allow engagement between the respective jaws.

3. An impact wrench according to claim 2, wherein said inner driven part of the hammer is provided with axially extending projections facing the motor, and the outer driven part of the hammer has recesses to receive the axially extending projections of the inner driven part of the hammer.

4. An impact wrench comprising: a casing; a motor accommodated in said casing and having a shaft; a spindle journalled in said casing; an anvil having impact jaws and an axial bore, said anvil being coupled to the spindle for rotation therewith and being substantially immovable in the axial direction; a counterbore in said axial bore of said anvil; a composite hammer accommodated in said casing and including a driving part coupled to said shaft of the motor, an outer driven part connected to said driving part for combined rotation and having impact jaws engageable with the impact jaws of said anvil, and an inner driven part connected to the outer driven part of the hammer for combined rotation, said inner driven part being received in said counterbore of the anvil and comprising an intermediate shaft having one end journalled in said axial bore of the anvil, said driven parts of the hammer being axially movable relative to said driving part of the hammer; flyweights located between said driving part of the hammer and said outer driven part of the hammer; axial movement of said driven parts of the hammer being caused by said flyweights; a return spring disposed between said driven parts of the hammer; a device for providing preliminary interaction of said hammer and anvil before engagement of their impact jaws, including movable spring-loaded locking members and cam surfaces of said anvil, said spring-loaded locking members being mounted in said inner driven part of the hammer and located in a locking position between the impact jaws of said hammer and anvil, a working spring received in said counterbore of the anvil between said inner driven part of the hammer and said anvil said locking member and cam surfaces interacting on movement of said inner driven parts of the hammer to move said locking members from between the respective impact jaws and allow engagement between the impact jaws.

* * * * *